US005857577A

United States Patent [19]

Thomas et al.

[11] Patent Number: 5,857,577

[45] Date of Patent: Jan. 12, 1999

[54] WALL-MOUNTABLE HANGER BRACKET ASSEMBLY

[76] Inventors: Kevin Thomas, 388 SE. 70th Ave., Pratt, Kans. 67124; George A. Dechant, Rte. 3, Box 29, Stafford, Kans. 67578

[21] Appl. No.: 892,370

[22] Filed: Jul. 14, 1997

[51] Int. Cl.[6] ..... A47F 7/00

[52] U.S. Cl. ..... 211/94.01

[58] Field of Search ..... 211/94.01, 103, 211/105.1, 88.01

[56] References Cited

U.S. PATENT DOCUMENTS

| | | | |
|---|---|---|---|
| 143,228 | 9/1873 | Doyle et al. . | |
| 1,493,264 | 5/1924 | Hennessy . | |
| 2,503,375 | 4/1950 | Burg | 211/87 |
| 2,626,714 | 1/1953 | Rover | 211/100 |
| 2,647,642 | 8/1953 | Kosash | 211/100 |
| 2,675,923 | 4/1954 | Humphrey | 211/96 |
| 3,158,113 | 11/1964 | Johnson | 108/64 |
| 3,976,200 | 8/1976 | Munns | 211/18 |
| 5,165,555 | 11/1992 | Anatalio | 211/96 |
| 5,236,095 | 8/1993 | Krizka | 211/96 |
| 5,509,541 | 4/1996 | Merl | 211/103 |
| 5,695,078 | 12/1997 | Otema | 211/103 |

*Primary Examiner*—Alvin Chin-Shue
*Assistant Examiner*—Sarah Purol
*Attorney, Agent, or Firm*—Flanagan & Flanagan; John K. Flanagan; John R. Flanagan

[57] ABSTRACT

A wall-mountable hanger bracket assembly includes a main frame, a plurality of horizontal beams, a plurality of first coupling members, a plurality of releasable securing members, a plurality of pairs of bracket members for receiving and supporting an article thereon, and a plurality of second coupling members. The main frame is securable to a wall. The horizontal beams are disposed between a pair of opposite upright side members of the main frame. The first coupling members slidably attach the horizontal beams to the upright side members of the main frame. The releasable securing members hold the first coupling members in place on the upright side members of the main frame. The second coupling members slidably and pivotably attach the bracket members to the horizontal beams. The bracket members vary in length with the shortest being at the level of the uppermost one of the horizontal beams and longest being at the level of the lowermost one of the horizontal beams.

22 Claims, 2 Drawing Sheets

WALL-MOUNTABLE HANGER BRACKET ASSEMBLY

BACKGROUND OF THE INVENTION

1. Field of the Invention

The present invention generally relates to storage of tools and like articles which are relatively large in size and, more particularly, is concerned with a wall-mountable hanger bracket assembly.

2. Description of the Prior Art

Garages and buildings of various kinds are common places for storage of a variety of articles, such as weed trimmers and like tools, which are typically used outside of residences, businesses and along public highways. These storage places often have only limited space and so must accommodate such articles in a manner which utilizes the available space in a highly efficient manner and places the article where it is less likely to be accidentally hit by and thus injure persons moving about the area.

Walls and ceilings have often been found as useful for the storage of articles within minimal space above floors. Various devices have been proposed over the years for hanging a variety of articles above floors and on walls or ceilings. Representative examples of these prior art devices are disclosed in U.S. Pat. No. 143,228 to Doyle et al., U.S. Pat. No. 1,493,264 to Hennessy, U.S. Pat. No. 2,503,375 to Burg, U.S. Pat. No. 2,626,714 to Rover, U.S. Pat. No. 2,647,642 to Kosash, U.S. Pat. No. 2,675,923 to Humphrey, U.S. Pat. No. 3,158,113 to Johnson, U.S. Pat. No. 3,976,200 to Munns, U.S. Pat. No. 5,165,555 to Anatalio and U.S. Pat. No. 5,236,095 to Krizka. While these prior art devices generally appear to be satisfactory in use for the specific purposes for which they were designed, none of them seem to provide optimum versatility to resolve the problem at hand that being to hold rather long irregular articles, such as gas powered weed trimmers and the like, in a generally horizontal position along a wall.

Consequently, a need remains for a device which will provide a comprehensive and yet simple solution to the aforementioned problem with the prior art devices without introducing any new problems in place thereof.

SUMMARY OF THE INVENTION

The present invention provides a wall-mountable hanger bracket assembly designed to satisfy the aforementioned need. The wall-mountable hanger bracket assembly of the present invention is easy to install and use. The wall-mountable hanger bracket assembly is more versatile than the prior art devices in that each hanger element is readily adjustable in horizontal and vertical directions. This adjustability enables the assembly to more effectively accommodate items having various irregular shapes and sizes, such as gas powered weed trimmers having either straight or curved shafts, by holding them in a generally horizontal position along a wall above a floor, allowing for safer and better organized and more compact storage.

Accordingly, the present invention is directed to a wall-mountable hanger bracket assembly which comprises: (a) a main frame having a pair of opposite upright side members; (b) fastening means for securing the main frame to a wall; (c) at least one and preferably a plurality of horizontal beams each having a pair of opposite ends; (d) a plurality of first coupling members; (e) a plurality of releasable securing members; (f) at least one pair and preferably a plurality of pairs of bracket members for receiving and supporting at least one article thereon; and (g) a plurality of second coupling members. Versatility is established by the plurality of first and second coupling members. The first coupling members enable the horizontal beams to slide in a vertical direction along the upright side members of the frame. The second coupling members enable the bracket members to slide in a horizontal direction along the horizontal beams.

In addition to the opposite upright side members, the main frame has a top member and a bottom member. The opposite upright side members extend between and interconnect the top and bottom members to one another so as to provide the main frame with a substantially rectangular configuration. Also, an elongated basket has a pair of hanger elements for removably hanging the basket from the bottom member of the frame.

Each horizontal beam has a length which is less than that of the top and bottom members of the main frame and less than the distance between the opposite upright side members of the main frame. Also each horizontal beam extends in the same plane of and between the opposite upright side members of the main frame. Each of the first coupling members is attached to a respective one of the opposite ends of one of the horizontal beams and is slidably coupled to one of the opposite upright side members of the main frame so as to undergo vertical sliding movement along the one upright side member of the main frame. Each of the releasable securing members is selectively adjustable to hold one of the first coupling members in a fixed position on one of the opposite upright side members of the main frame and to release the one first coupling member from the fixed position to permit slidable movement of the one first coupling member along the one upright side member of the main frame.

Each of the plurality of pairs of bracket members includes an arm and hook thereon. The arm has an inner end and an outer end. The hook is attached at the outer end of the arm. The hook is configured for receiving and supporting an article thereon. The pairs of bracket members vary in length with preferably the shortest being at the level of an uppermost one of the horizontal beams and longest being at the level of a lowermost one of the horizontal beams. However, the bracket members may have any suitable length at any particular level.

Each of the second coupling members is pivotally mounted to the inner end of the arm of one of the bracket members and slidably mounted to one of the horizontal beams. The second coupling members permit the bracket members to slide along the horizontal beams and to pivot relative thereto. Each bracket member is pivotable between a retracted position in which the bracket member is disposed in a substantially parallel relationship to the respective horizontal beam and an extended position in which the bracket member is disposed in a substantially perpendicular relationship to the respective horizontal beam.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
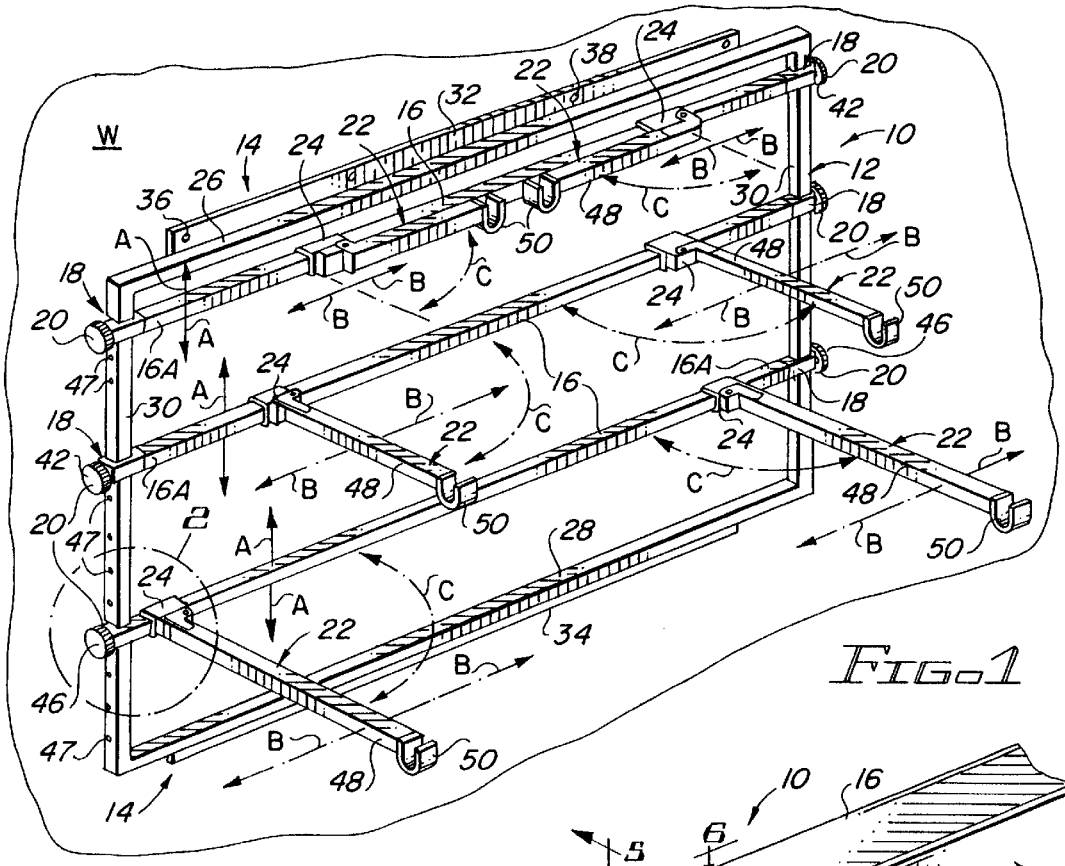
FIG. 1 is a left front perspective view of a wall-mountable hanger bracket assembly of the present invention.

Referring to the drawings and particularly to FIGS. 1 to 6, there is illustrated a wall-mountable hanger bracket assembly, generally designated 10, of the present invention. Basically, the wall-mountable hanger bracket assembly 10 includes a main frame 12, fastening means 14 for securing the main frame 12 to a wall W, at least one and preferably a plurality of horizontal beams 16, a plurality of first coupling members 18, a plurality of releasable securing members 20, at least one pair and preferably a plurality of pairs of bracket members 22 for receiving and supporting articles thereon, and a plurality of second coupling members 24. The versatility of the assembly 10 is established by the first and second coupling members 18, 24. The first coupling members 18 enable the horizontal beams 16 to slide along a substantially linear vertical path, as depicted by arrows A in FIGS. 1 and 2, relative to the main frame 12. The second coupling members 24 enable the pairs of bracket members 22 to slide along a substantially linear horizontal path, as depicted by arrows B in FIGS. 1 and 2, relative to the horizontal beams 16, and to pivot along a substantially arcuate-shaped horizontal path, as depicted by arrows C in FIGS. 1 and 2.

Referring to FIG. 1, the main frame 12 of the assembly 10 includes a top member 26, a bottom member 28 and a pair of opposite upright side members 30 which extend between and are interconnected to the top and bottom members 26, 28 so as to provide the main frame 12 with a substantially rectangular configuration in which the top and bottom members 26, 28 are spaced apart and extend substantially parallel to one another as do the respective upright side members 30 with respect to one another. The top member 26, bottom member 28 and opposite upright side members 30 are each preferably of a substantially straight configuration and constructed of a square tubing made of a substantially rigid metal material, but each may be constructed into any other suitable shape and/or made of any other suitable material. Each member 26, 28 and 30 may also have any desirable and suitable length so as to form a main frame 12 of any desirable and suitable size.

Figure 8:
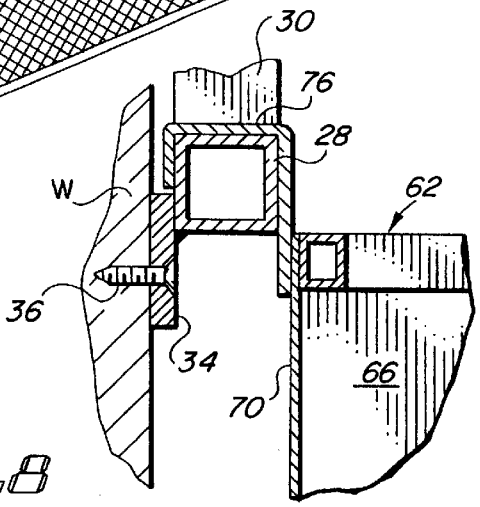
FIG. 8 is an enlarged fragmentary sectional view taken along line 8—8 of FIG. 7.

Referring to FIGS. 1 and 8, the fastening means 14 of the assembly 10 includes an upper flange 32, a lower flange 34 and a plurality of fastener elements preferably, although not necessarily, in the form of screws 36. The upper flange 32 is fixedly attached to and extends above the top member 26 of the main frame 12 and defines a plurality of holes 38 therethrough. The lower flange 34 is fixedly attached to and extends below the bottom member 28 of the main frame 12 and defines a similar plurality of holes 38 therethrough. The plurality of screws 36 are removably and securably insertable through the plurality of holes 38 defined by the upper and lower flanges 32, 34 and into the wall W for fastening the upper flange 32 and lower flange 34 and thereby the main frame 12 to the wall W. The upper and lower flanges 32, 34 are attached along respective rear sides of the top and bottom members 26, 28 of the main frame 12 so as to space the top and bottom members 26, 28 and thereby the main frame 12 at a sufficient distance or gap outwardly from the wall W, as best seen in FIG. 8, to permit the first coupling members 18 to easily slide along the opposite upright side members 30 of the main frame 12 and the second coupling members 24 to easily slide along the horizontal beams 16 without rubbing against the wall W. The upper and lower flanges 32, 34 are of a substantially straight configuration and made of a substantially rigid metal material, but may be constructed into any other suitable shape and/or made of any other suitable material. The upper and lower flanges 32, 34 generally have the same length and width as one another, but may have any other suitable length and width. The upper and lower flanges 32, 34 also generally have lengths and widths which are less than the lengths and widths of the top and bottom members 26, 28, but may have lengths and widths of any other suitable size in relation to the same of the top and bottom members 26, 28.

Each horizontal beam 16 is substantially similar in construction and composition to the members 26, 28 and 30 of the main frame 12, but may be of a construction and/or composition which is different from that of the members 26, 28 and 30 of the main frame 12. Horizontal beams 16 are accordingly of substantially straight configuration and made of a square tubing comprised of a substantially rigid metal material, but may also be constructed into any other suitable shape and/or made of any other suitable material. Each horizontal beam 16 preferably has any suitable length which is less than the distance between the opposite upright side members 30 of the main frame 12 so that the horizontal beams 16 can fit between the upright side members 30 and extend within the same plane as the members 26, 28, 30 making up the main frame 12.

Figure 2:
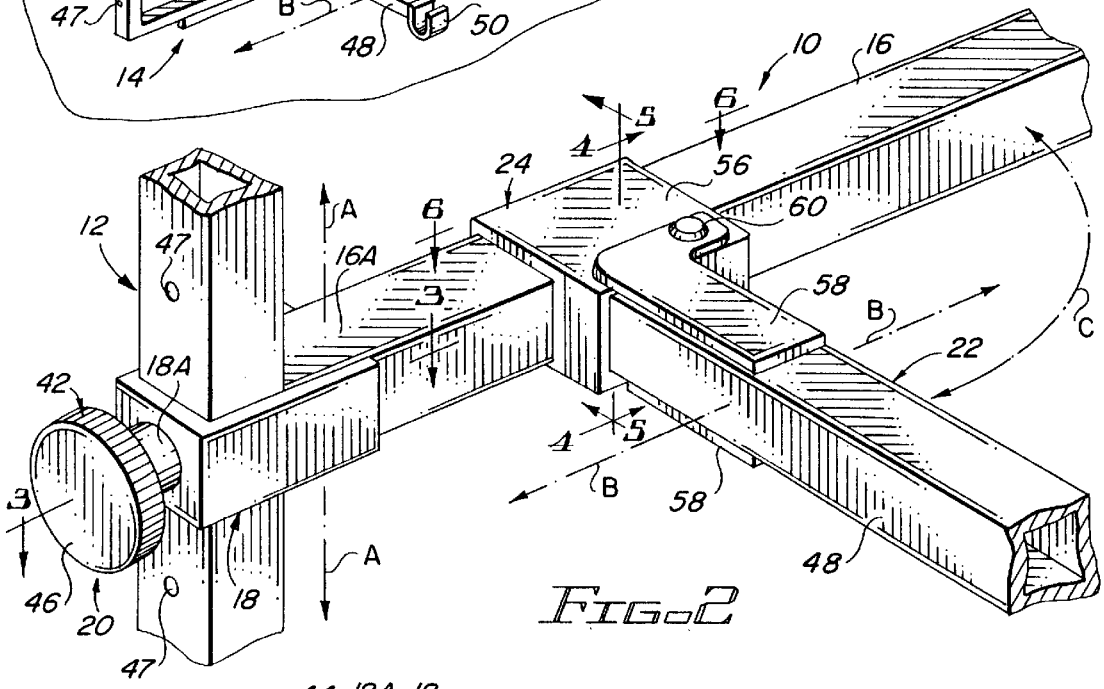
FIG. 2 is an enlarged detailed fragmentary view of the portion of the assembly encompassed by circle 2 in FIG. 1.
Figure 3:
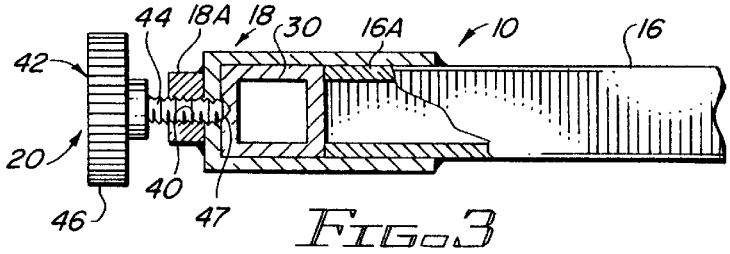
FIG. 3 is a fragmentary, partly sectional, view of the assembly taken along line 3—3 of FIG. 2.

Referring now to FIGS. 1 to 3, each of the first coupling members 18 of the assembly 10 is attached to a respective one of the opposite ends 16A of one of the horizontal beams 16 and is slidably coupled to a respective one of the opposite upright side members 30 of the main frame 12 so as to be capable of undergoing vertical sliding movement along the respective one upright side member 30, enabling the vertical sliding movement of each horizontal beam 16 along the upright side members 30 of the main frame 12. In an exemplary embodiment best seen in FIGS. 2 and 3, each first coupling member 18 is in the form of a rigid U-shaped strap which is fixedly attached to the respective one of the opposite ends 16A of the horizontal beam 16 and surrounds and conforms to the cross-sectional shape and size of the upright side member 30. The first coupling member 18 also has an enlarged or thickened portion 18A thereon which defines a threaded internal passageway 40 extending in a generally perpendicular relationship to the respective upright side member 30 of the main frame 12.

Each of the releasable securing members 20 of the assembly 10 is selectively adjustable to hold one of the first coupling members 18 in a fixed position on the respective one of the opposite upright side members 30 of the main frame 12 or to release the one first coupling member 18 from the fixed position to permit slidable movement of the one first coupling member 18 along the one upright side member 30 of the main frame 12, enabling the vertical sliding movement of each horizontal beam 16 along the upright side members 30 of the main frame 12. In an exemplary embodiment best seen in FIGS. 1 to 3, each securing member 20 is in the form of a knob 42 having an externally threaded shaft 44 and a round head 46 rigidly attached to an outer end thereof for gripping by an user to rotate the knob 42 to selectively adjust the securing member 20 between tightened and untightened positions relative to the respective upright side member 30. The externally threaded shaft 44 is threadably inserted through the threaded internal passageway 40 defined by the first coupling members 18 for contacting the one upright side member 30 of the main frame 12. Indents 47 are defined along the outside surfaces of the upright side members 30 at vertically spaced positions for receiving the inner ends of the shaft 44. Rotation of each of the knobs 42 in one direction causes its externally threaded shaft 44 to make contact with the one upright side member 30 of the main frame 12 and fixedly hold the first coupling member 18 in a respective one of the positions defined by the indents 47 along the one upright side member 30 of the main frame 12. Rotation of the knob 42 in the opposite direction causes its externally threaded shaft 44 to release from the one upright side member 30 of the main frame 12 so as to permit slidable movement of the one first coupling member 18 along the one upright side member 30 of the main frame 12.

Figure 4:
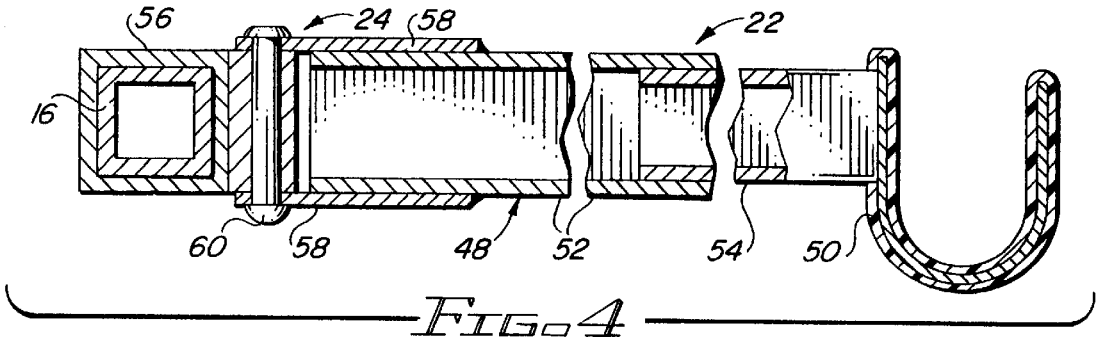
FIG. 4 is a sectional view of the assembly taken along line 4—4 of FIG. 2 and in addition showing an arm of a bracket member having inner and outer portions being telescopically connected together and movable relative to one another.
Figure 5:
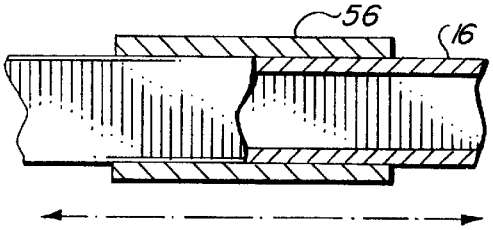
FIG. 5 is a sectional view of the assembly taken along line 5—5 of FIG. 2.
Figure 6:
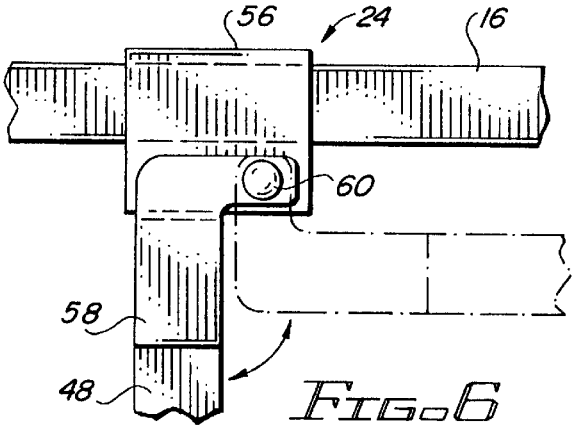
FIG. 6 is a fragmentary top plan view of the assembly as seen along line 6—6 of FIG. 2.

Referring to FIGS. 1, 2 and 4 to 6, each of the bracket members 22 of the assembly 10 includes an arm 48 and a hook 50. The arm 48 has an inner end 48A and an outer end 48B. The arm 48 is preferably of substantially straight configuration and made of a square tubing of a substantially rigid metal material, but may be constructed into any other suitable shape and/or made of any other suitable material. The arm 48 is thus substantially similar in construction and composition to the horizontal beams 16 and members 26, 28 and 30 of the main frame 12, but may be of a construction and/or composition which is different therefrom. Furthermore, each arm 48 can be a one-piece member of fixed length or, alternatively, as seen in FIG. 4, each arm 48 can have an inner portion 52 and an outer portion 54 which is telescopically mounted to the inner portion 52 for undergoing extensible and retractible movement relative thereto to respectively increase and decrease the length of the arm 48 as desired.

The hook 50 of each bracket member 22 is attached at the outer end 48B of the arm 48. The hooks 50 of the bracket members 22 are configured for receiving and supporting the articles thereon. Each hook 50 generally has a substantially U-shaped configuration and is made preferably of a substantially rigid material covered by a resilient pliable material, but may have any other suitable shape and/or may be made of any other suitable material. As readily apparent in FIG. 1, the respective pairs of the bracket members 22 vary in length with preferably the shortest pair being at the level of an uppermost one of the horizontal beams 16 and the longest pair being at the level of a lowermost one of the horizontal beams 16. However, the bracket members 22 may have any suitable length at any particular level.

Each of the second coupling members 24 of the assembly 10 is pivotally mounted to the inner end 48A of the arm 48 of one of the bracket members 22 and slidably mounted to a respective one of the horizontal beams 16 such that each bracket member 22 is slidable along the horizontal beam 16 and is pivotable relative to the horizontal beam 16 between a retracted position (see the uppermost pair of bracket members 22 in FIG. 1) in which the bracket members 22 are disposed in substantially parallel relationship to the horizontal beam 16 and an extended position (see the middle and lowermost pairs of bracket members 22 in FIG. 1) in which the bracket members 22 are disposed in a substantially perpendicular relationship to the horizontal beams 16. Each second coupling member 24 has a sleeve-shaped slider 56 slidably installed over one of the horizontal beams 16, a pair of L-shaped flat tabs 58 attached to the inner end of one of the arms 48, and a pivot pin 60 hingedly interconnecting the tabs 58 with the slider 56. More particularly, the slider 56 and tabs 58 have respective holes aligned with one another through which the pivot pin 60 extends to form a hinge between the tabs 58 and slider 56. The tabs 58 are fixedly attached to the inner end 48A of the arm 48 and project outwardly therefrom so as to overlap with a portion of the slider 56.

Figure 7:
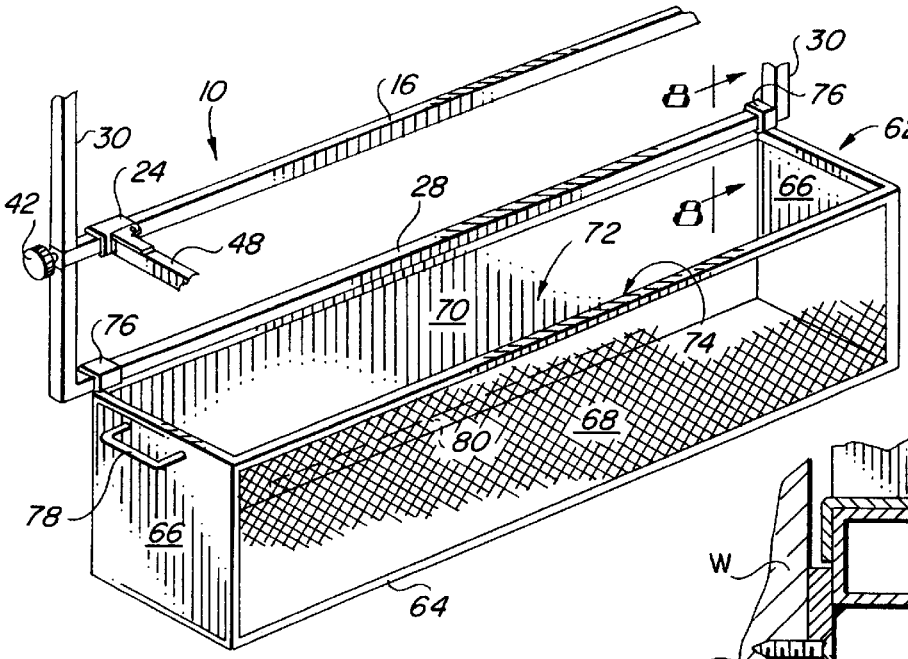
FIG. 7 is a left front perspective view of an elongated basket hanging from the wall-mountable hanger bracket assembly of the present invention.

Referring to FIGS. 7 and 8, there is illustrated an elongated basket, generally designated 62, for storing miscellaneous articles. The basket 62 has a generally rectangular configuration and is adapted to hang from the bottom member 28 of the main frame 12 of the wall-mountable hanger bracket assembly 10 in accordance with the present invention. In an exemplary embodiment, the basket 62 has a bottom wall 64, a pair of end walls 66 and front and rear walls 68, 70 all being interconnected to define an interior storage cavity 72 open at the top 74. A pair of hanger elements 76 are fixedly attached to an upper edge portion of the rear wall 70 adjacent to opposite ends thereof and have C-shaped configurations allowing them to be hooked over the bottom member 28 of the main frame 12, as best seen in FIG. 8. Also, a pair of handles 78 are fixed to the exterior of the opposite end walls 66 of the basket 62 permitting it to be easily lifted and unhooked from the main frame 12. Further, an elongated foot 80 is attached to the lower rear edge of the basket 62 for resting against the wall.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

We claim:

1. A wall-mountable hanger bracket assembly, comprising:

(a) a main frame having a pair of opposite upright side members;

(b) means for fastening said main frame to a wall;

(c) at least one horizontal beam having a pair of opposite ends;

(d) a plurality of first coupling members each attached to a respective one of said opposite ends of said horizontal beam and slidably coupled to one of said opposite upright side members of said main frame so as to permit said horizontal beam to undergo substantially vertical sliding movement along said opposite upright side members of said main frame;

(e) a plurality of releasable securing members each being selectively adjustable to hold one of said first coupling members in a fixed position on a respective one of said opposite upright side members of said main frame and to release said one first coupling member from said fixed position to permit slidable movement of said one first coupling members along said one opposite upright side member of said main frame;

(f) at least one pair of bracket members for receiving and supporting at least one article thereon, each of said bracket members including an elongated arm having an inner end; and (g) a plurality of second coupling members each being pivotally mounted to said inner end of said arm of one of said bracket members and slidably mounted to said horizontal beam such that each of said bracket members is slidable along said horizontal beam and pivotable relative thereto between a retracted position in which said bracket member is disposed in a substantially parallel relationship to said horizontal beam and an extended position in which said bracket member is disposed in a substantially perpendicular relationship to said horizontal beam.

2. The assembly of claim 1 wherein each of said first coupling members defines a threaded internal passageway.

3. The assembly of claim 2 wherein each of said releasable securing members is a knob having a grippable head and an externally threaded shaft interconnected therewith and being threadably inserted through said threaded internal passageway defined by one of said first coupling members for contacting said one of said opposite upright side members of said main frame such that rotation of said knob in one direction causes said externally threaded shaft to make contact with said one opposite upright side member and hold said one first coupling member in a fixed position along said one opposite upright side member while rotation of said knob in the opposite direction causes said externally threaded shaft to release from said one opposite upright side member so as to permit slidable movement of said one first coupling member along said one opposite upright side member.

4. The assembly of claim 1 wherein:

said arm of each of said bracket members further has an outer end; and each of said bracket members further includes a hook attached at said outer end of said arm and configured for receiving and supporting an article thereon.

5. The assembly of claim 4 wherein said hook of each of said bracket members has a substantially U-shaped configuration.

6. The assembly of claim 1 wherein said arm of each of said bracket members has an inner portion and an outer portion telescopically mounted to said inner portion for undergoing extensible and retractible movement relative thereto to respectively increase and decrease the length of said arm.

7. A wall-mountable hanger bracket assembly, comprising:

(a) a main frame having a top member, a bottom member and a pair of opposite upright side members extending between and interconnecting the top and bottom members to one another so as to provide said main frame with a substantially rectangular configuration;

(b) means for fastening said main frame to a wall;

(c) at least one horizontal beam having a pair of opposite ends;

(d) a plurality of first coupling members each attached to a respective one of said opposite ends of said horizontal beam and slidably coupled to one of said opposite upright side members of said main frame so as to permit said horizontal beam to undergo substantially vertical sliding movement along said opposite upright side members of said main frame;

(e) a plurality of releasable securing members each being selectively adjustable to hold one of said first coupling members in a fixed position on a respective one of said opposite upright side members of said main frame and to release said one of said first coupling members from said fixed position to permit slidable movement of said one first coupling member along said one opposite upright side member of said main frame;

(f) at least one pair of bracket members for receiving and supporting at least one article thereon, each of said bracket members including an elongated arm having an inner end and an outer end, and a hook attached at said outer end of said arm, said hook being configured for receiving and supporting the article thereon; and (g) a plurality of second coupling members each being pivotally mounted to said inner end of said arm of one of said bracket members and slidably mounted to said horizontal beam such that each of said bracket members is slidable along said horizontal beam and pivotable relative thereto between a retracted position in which said bracket member is disposed in a substantially parallel relationship to said horizontal beam and an extended position in which said bracket members is disposed in a substantially perpendicular relationship to said horizontal beam.

8. The assembly of claim 7 further comprising:

(h) an elongated basket having a pair of hanger elements for removably hanging said basket from said frame.

9. The assembly of claim 7 wherein each of said bracket members has an inner portion and an outer portion telescopically mounted to said inner portion for undergoing extensible and retractible movement relative thereto to respectively increase and decrease the length of said bracket member.

10. The assembly of claim 7 wherein said hook of each of said bracket members has a substantially U-shaped configuration.

11. The assembly of claim 7 wherein said means for fastening said main frame to the wall includes:

an upper flange attached to and extending above said top member of said main frame and defining a plurality of holes therethrough;

a lower flange attached to and extending below said bottom member of said main frame and spacing said bottom member outwardly from the wall, said lower flange defining a plurality of holes therethrough; and a plurality of fastener elements removably and securably insertable through said plurality of holes defined by said upper and lower flanges and to the wall for fastening said upper and lower flange and thereby said main frame to the wall.

12. The assembly of claim 11 further comprising:

(h) an elongated basket having a pair of hanger elements for removably hanging said basket from said bottom member of said frame.

13. The assembly of claim 7 wherein each of said first coupling members defines a threaded internal passageway.

14. The assembly of claim 13 wherein each of said releasable securing members is a knob having a grippable head and an externally threaded shaft interconnected therewith and being threadably inserted through said threaded internal passageway defined by one of said first coupling members for contacting said one of said opposite upright side members of said main frame such that rotation of said knob in one direction causes said externally threaded shaft to make contact with said one opposite upright side member and hold said one first coupling member in a fixed position along said one opposite upright side member while rotation of said knob in the opposite direction causes said externally threaded shaft to release from said one opposite upright side member so as to permit slidable movement of said one first coupling member along said one opposite upright side member.

15. A wall-mountable hanger bracket assembly, comprising:

(a) a main frame having a top member, a bottom member and a pair of opposite upright side members extending between and interconnecting the top and bottom members to one another so as to provide said main frame with a substantially rectangular configuration;

(b) means for fastening said main frame to a wall;

(c) a plurality of horizontal beams each having a pair of opposite ends;

(d) a plurality of first coupling members each attached to a respective one of said opposite ends of said horizontal beams and slidably coupled to one of said opposite upright side members of said main frame so as to permit said horizontal beams to undergo vertical sliding movement along said opposite upright side members of said main frame;

(e) a plurality of releasable securing members each being selectively adjustable to hold one of said first coupling members in a fixed position on a respective one of said opposite upright side members of said main frame and to release said one of said first coupling members from said fixed position to permit slidable movement of said one first coupling member along said one opposite upright side members of said main frame;

(f) a plurality of pairs of bracket members for receiving and supporting articles thereon, each of said bracket members including an elongated arm having an inner end and an outer end, and a hook attached at said outer end of said arm, said hook being configured for receiving and supporting the article thereon; and (g) a plurality of second coupling members each being pivotally mounted to said inner end of said arm of one of said bracket members and slidably mounted to a respective one of said horizontal beams such that each of said bracket members is slidable along said respective one of said horizontal beams and pivotable relative thereto between a retracted position in which each of said bracket members is disposed in a substantially parallel relationship to said respective one of said horizontal beams and an extended position in which each of said bracket members is disposed in a substantially perpendicular relationship to said respective one of said horizontal beams.

16. The assembly of claim 15 wherein each of said bracket members has an inner portion and an outer portion being telescopically mounted to said inner portion for undergoing extensible and retractible movement relative thereto to respectively increase and decrease the length of said bracket member.

17. The assembly of claim 15 wherein said hook of each of said bracket members has a substantially U-shaped configuration.

18. The assembly of claim 15 wherein said means for fastening said main frame to the wall includes:

an upper flange attached to and extending above said top member of said main frame and defining a plurality of holes therethrough;

a lower flange attached to and extending below said bottom member of said main frame and spacing said bottom member outwardly from the wall, said lower flange defining a plurality of holes therethrough; and a plurality of fastener elements removably and securably insertable through said plurality of holes defined by said upper and lower flanges and to the wall for fastening said upper and lower flanges and thereby said main frame to the wall.

19. The assembly of claim 18 further comprising:

(h) an elongated basket having a pair of hanger elements for removably hanging said basket from said bottom member of said frame.

20. The assembly of claim 15 wherein each of said first coupling members defines a threaded internal passageway.

21. The assembly of claim 20 wherein each of said releasable securing members is a knob having a grippable head and an externally threaded shaft interconnected therewith and being threadably inserted through said threaded internal passageway defined by one said first coupling members for contacting said one of said opposite upright side members of said main frame such that rotation of said knob in one direction causes said externally threaded shaft to make contact with said one opposite upright side member and hold said one first coupling members in a fixed position along said one opposite upright side members while rotation of said knob in the opposite direction causes said externally threaded shaft to release from said one opposite upright side members so as to permit slidable movement of said one first coupling member along said one opposite upright side member.

22. The assembly of claim 15 wherein said pairs of said bracket members vary in length with the shortest being at the level of an uppermost one of said horizontal beams and longest being at the level of a lowermost one of said horizontal beams.

* * * * *